US005755632A

United States Patent [19]

Eddy

[11] Patent Number: 5,755,632

[45] Date of Patent: May 26, 1998

[54] BALL RETRIEVAL, STORAGE, DISPENSING AND COURT TARGET PRACTICE DEVICE

[76] Inventor: David Eddy, 4481 E. Lake Rd., Cazenovia, N.Y. 13035

[21] Appl. No.: 797,009

[22] Filed: Feb. 7, 1997

[51] Int. Cl.[6] ..... A63B 69/38

[52] U.S. Cl. ..... 473/460; 473/464; 224/919; 294/19.2

[58] Field of Search ..... 473/459, 460, 473/464, 115; 224/919; 294/19.2; 221/307, 310

[56] References Cited

U.S. PATENT DOCUMENTS

| | | | |
|---|---|---|---|
| 1,937,828 | 12/1933 | MacDonald | 294/19.2 |
| 2,760,807 | 8/1956 | Watson | 294/19.2 |
| 4,058,336 | 11/1977 | Parkinson | 294/19.2 |
| 5,060,996 | 10/1991 | Garnes | 294/19.2 |
| 5,147,101 | 9/1992 | Tiller | 294/19.2 |
| 5,188,410 | 2/1993 | Summers | 473/460 X |
| 5,466,027 | 11/1995 | Hockey | 294/19.2 |

FOREIGN PATENT DOCUMENTS

| | | | |
|---|---|---|---|
| 2621891 | 4/1989 | France | 294/19.2 |
| 3132761 | 3/1983 | Germany | 294/19.2 |
| 4308662 | 9/1994 | Germany | 294/19.2 |
| 8303553 | 10/1983 | WIPO | 294/19.2 |

*Primary Examiner*—Raleigh W. Chiu

[57] ABSTRACT

A ball retrieval, storage, and dispensing system having a hollow tube with a diameter slightly larger than a ball that is to be placed within the tube. Positioned at the top of the hollow tube is an upper cap having a hollow center portion and at least two hook members. Integrally molded about a ridge on the annular ring is a flange member having an upper diameter and a lower diameter. The lower diameter is slightly larger than the circumference of a ball to be placed with the tube and the upper diameter is slightly smaller than the circumference of the same ball. The flange member is made from a resilient flexible material which enables the upper diameter of the flange member to bend inwardly when a ball is "squeezed" through the annular ring and return to its original position after the ball has completely passed through the upper cap. An elastic retaining band, in conjunction with the resilient flexible flange member, permits the balls to be securely stored within the hollow tube. The balls can be removed from the hollow tube when the elastic retaining band is removed from the hook members.

19 Claims, 7 Drawing Sheets

BALL RETRIEVAL, STORAGE, DISPENSING AND COURT TARGET PRACTICE DEVICE

FIELD OF THE INVENTION

The present invention relates generally to a ball retrieval system. In particular, the present invention relates to a tennis ball retrieval, holding, and dispensing system that allows a user to retrieve tennis balls, hold the tennis balls and when needed dispense the tennis balls from the system during tennis play or at other times.

BACKGROUND OF THE INVENTION

It is not uncommon for ten or more tennis balls to be on a tennis court at one time during a typical practice session of tennis. Once a session is complete or all the balls are used, however, they must be picked-up in order to start another practice round. This is done not only for the safety of the players, but also to also also keep the court free of tennis balls for the next set of play. In order to retrieve the tennis balls from the court, the player has to pick up each individual tennis ball by hand. This usually means that the player must squat or bend down each time a ball is picked up. This is usually performed without the aid of a tennis ball holder or other similar device.

In addition to squatting or bending down several times to pick up each individual ball, the player has to then walk to a specific location where the balls are being stored, e.g., a tennis bin, for storage and future retrieval of the balls during the ensuing set. This takes many trips across the court since the player can only hold a limited amount of tennis balls at one time. This process is very frustrating and time consuming to the player.

Tennis ball retrieval systems, however, have been devised to assist the player in retrieving those tennis balls that are on the court. Typically these tennis ball retrieval systems are complex systems that assist the tennis player in retrieving tennis balls during play. This permits the user to play with a limited amount of tennis balls without the worry of having to manually retrieve the balls. These systems are very difficult to install and in most instances are a permanent feature to the tennis court.

These systems usually consist of troughs that run the length of the tennis net and side courts. In addition to the troughs are conveyors and other complicated retrieval mechanisms such as ball stackers and holding systems. As can be imagined, only the most exclusive clubs have tennis courts equipped with these systems due to the expensive nature of these systems and their installation.

Manual tennis retrieval systems have also been invented. Some of these systems combine tennis ball canisters with caps or other devices in order to hold the tennis balls. These systems, however, only hold a limited amount of balls, e.g., six, and are limited in their use. To this end, these systems do not allow the player to dispense the balls during play.

To overcome the shortcomings of present tennis ball retrieval systems a new method and apparatus having storage and dispensing means is needed. This system would be light weight and enable the player to pick up balls without having to squat down to retrieve each individual ball. This system would also include a mechanism for storing and dispensing the balls.

SUMMARY OF THE INVENTION

It is therefore an object of the present invention to provide a ball retrieval system that enables the player to pick up balls without squatting or bending down.

It is a further object of the present invention to provide a ball retrieval system that stores a multitude of balls at one time.

It is an additional object of the present invention to provide a ball retrieval system that enables the player to dispense one ball at a time during play.

It is still a further object of the present invention to provide a permanent holding compartment for the storage of balls.

It is also an object of the present invention to provide a combined ball retrieval, storage, and dispensing system.

It is still another object of the present invention to provide a ball dispenser that can be used as a teaching and practice aid.

These and other objects and advantages of the present invention will be apparent to those of ordinary skill in the art upon inspection of the detailed description, drawings, and appended claims.

The present invention is a ball retrieval, storage, and dispensing system ("ball system") comprising a hollow tube having an inner diameter slightly larger than a ball that is to be placed within the ball system. Positioned at the top of the hollow tube is an upper cap having a hollow center portion and at least two hook members.

Positioned at the bottom of the hollow tube is a lower cap having a ridge. Integrally molded about the ridge is a resilient flexible flange member having an upwardly and outwardly annular ring with an upper inner diameter and a lower inner diameter. In the preferred embodiment, the lower inner diameter is slightly larger than the diameter of a ball, and the upper inner diameter is slightly smaller than the diameter of the same ball.

The flange member is made from a resilient flexible material which enables the upper inner diameter of the flange member to bend inwardly when a ball is "squeezed" through the lower cap. This flexible material then permits the upper inner diameter to return to its original position after the ball has completely passed through the upper cap.

An elastic retaining band, in conjunction with the resilient flexible flange member, permits the balls to be securely stored within the hollow tube. The balls can be removed from the hollow tube when the elastic retaining band is removed from the hook members.

In order to pick up balls with the ball system a person places the lower cap directly over the ball to be picked up. The person then presses the ball system onto the ball until the ball passes entirely through the resilient flexible flange member and into the hollow tube. Once the balls are retained within the hollow tube the elastic retaining band may be placed over the hook members. Of course, the elastic retaining band may be placed over the hook members prior to picking up the balls.

The ball system may also be used as a tennis ball dispenser and practice and teaching aid. In this case the elastic retaining band is removed from the hook members so that the balls may be removed from the upper cap area. As the balls are being removed one at a time, the player can hit the balls with either a forehand or backhand stroke. This enables the player to practice both of these strokes.

DETAILED DESCRIPTION OF THE PRESENT INVENTION

Figure 1:
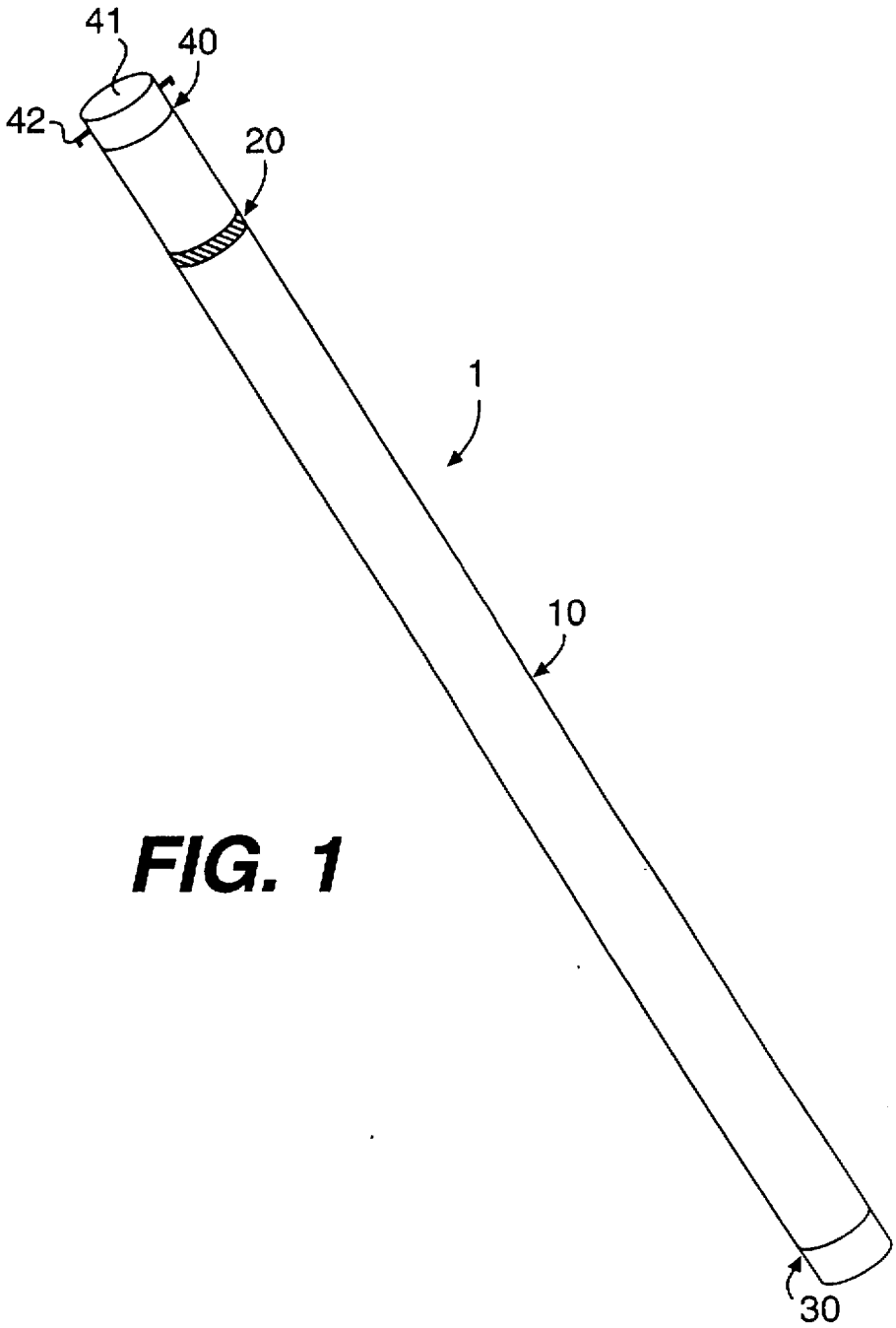
FIG. 1 shows a plan view of a ball retrieval, storage and dispensing system.

FIG. 1 shows a plan view of a ball retrieval, storage, and dispensing system (the "ball system") generally depicted as 1. The ball system 1 is also used for a tennis practice and teaching aid. The ball system 1 is preferably constructed from lightweight, flexible, and durable materials.

In the preferred embodiment, the ball system 1 comprises a hollow tube 10 having a diameter slightly larger than a tennis ball. Other diameter sized tubes are contemplated for use by the present invention, depending on the particular ball to be retrieved, such as baseballs, racquet balls, and softballs to name but a few.

Positioned at the top of the hollow tube 10 is an upper cap 40 having a hollow center portion 44. The inner diameter of the hollow center 44 is slightly larger than the diameter of a tennis ball. This configuration allows the tennis ball to be easily dispensed from the ball system 1. Integrally molded to the upper cap 40 are at least two hook members 42.

Positioned at the bottom of the hollow tube 10 is a lower annular ring member 30 having a resilient flexible flange member (not shown). An elastic retaining band 20 is also provided about the hollow tube 10. The elastic retaining band 20 can be placed around the hook members 42 and stretched over the hollow center portion 44 of the upper cap 40. This prevents the balls from falling out of the upper end of the hollow tube 10.

Figure 2:
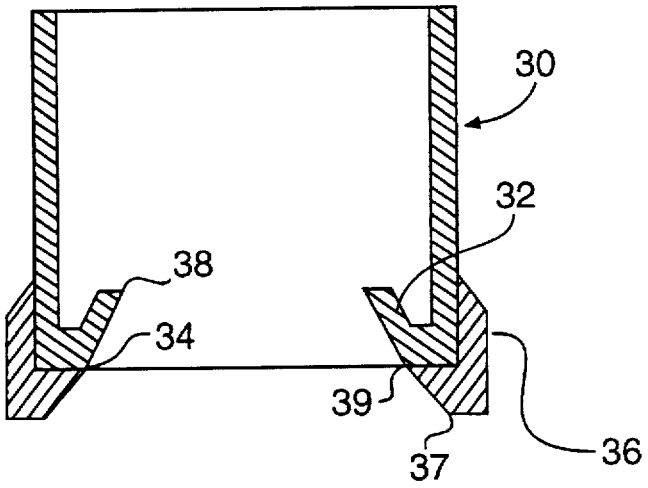
FIG. 2 shows a cut away side view of a lower cap having a flange.

FIG. 2 shows a cut away section side view of the lower annular ring member 30. Molded about the annular ring 30 is a ridge 36. The ridge 36 has an inner upper diameter 39 and an inner lower diameter 37. The inner lower diameter 37 of the ridge 36 is larger than the inner diameter of the of the hollow tube 10. The inner lower diameter 37 of the ridge 36 is also larger a ball that is retrieved by the present system. The upper inner diameter 39 of the ridge 36 is slightly smaller than the lower inner diameter 37 of the ridge 36, and upper diameter 39 is slightly larger than the diameter of a tennis ball. This configuration enables the user to place the present invention over the ball with ease. In alternate embodiments, the lower diameter 37 and upper diameter 39 may vary depending on the particular ball that is being retrieved by the present invention.

FIG. 2 also shows the resilient flexible flange member 32 integrally molded within ridge 36. The resilient flexible flange member 32 is defined as an upwardly and outwardly pointed (toward the interior of the tube) annular ring having an upper diameter 38 and a lower diameter 34. In the preferred embodiment, the lower diameter 34 is slightly larger than the diameter of the tennis ball, and the upper diameter 38 is slightly smaller than the diameter of the tennis ball. The lower diameter 34 is preferably the same diameter as the upper inner diameter 39 of the ridge 36. In alternate embodiments, the lower diameter 34 and upper diameter 38 may vary depending on the particular ball that is being retrieved by the present invention. When using other sized balls, the upper diameter 38 of the resilient flexible flange member 32 must be slightly smaller than the ball being placed within the hollow tube 10, and the lower diameter 34 must be slightly larger than the ball being placed within the hollow tube 10.

The flange member 32 is made from a resilient flexible material which enables the upper diameter 38 of the flange member 32 to bend inwardly (toward the walls of the tube) when a ball is "squeezed" through the lower annular ring member 30 by pushing the entire system down on the ball. This flexible material then permits the upper diameter 38 to return to its original position after the ball has completely passed through the lower annular ring member 30. This enables the ball, once picked up, to be firmly and securely stored in the hollow tube 10.

Figure 3:
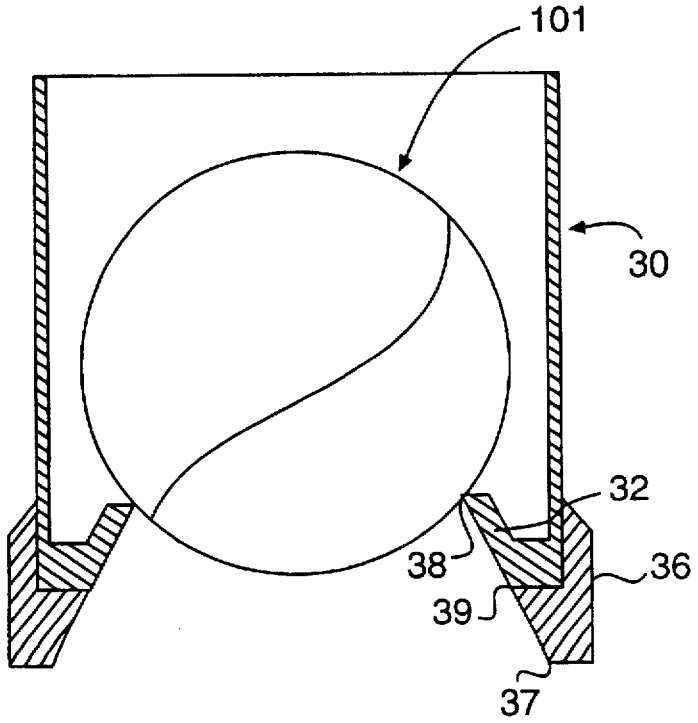
FIG. 3 shows a side cut away view of the lower cap.

FIG. 3 shows the ball 101 placed above the upper diameter 38 of the resilient flexible flange member 32. As previously stated, the lower diameter 34 is slightly larger than the diameter of the ball 101, and the upper diameter 38 is slightly smaller than the circumference of the ball 101. Once the ball passes completely through the lower annular ring member 30, the upper diameter 38 of the resilient flexible flange member 32 returns to its original position. At this point, the ball 101 is securely placed within the hollow tube 10 and cannot be removed easily through the lower annular ring member 30.

Figure 4:
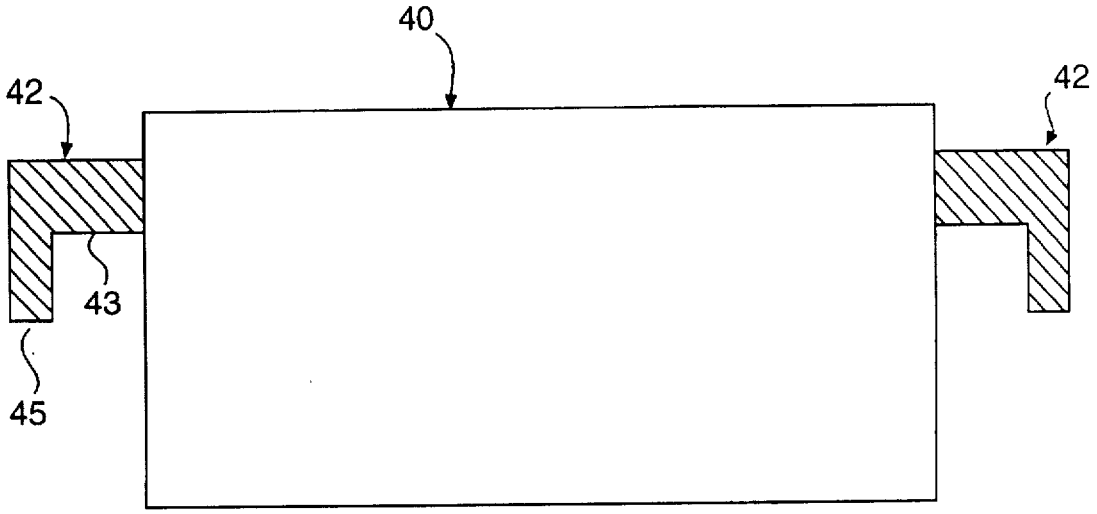
FIG. 4 shows a side view of an upper cap having a hook mechanism.

FIG. 4 shows a side view of the upper cap 40. Attached to the upper cap 40 are hook members 42. The hook members 42 comprise a horizontal leg 43 which is attached to the upper cap 40, and a downward depending arm 45 integrally molded to the horizontal leg 43. In the preferred embodiment, the hook members 42 are integrally molded to the upper cap 40. The hook members 42 secure the elastic retaining band 20 about the hollow center 44 of the upper cap 40. The elastic retaining band 20, in conjunction with the resilient flexible flange member 32, securely stores the balls within the hollow tube 10. The balls can be removed from the hollow tube 10 when the elastic retaining band 20 is removed from the hook members 42.

Figure 5:
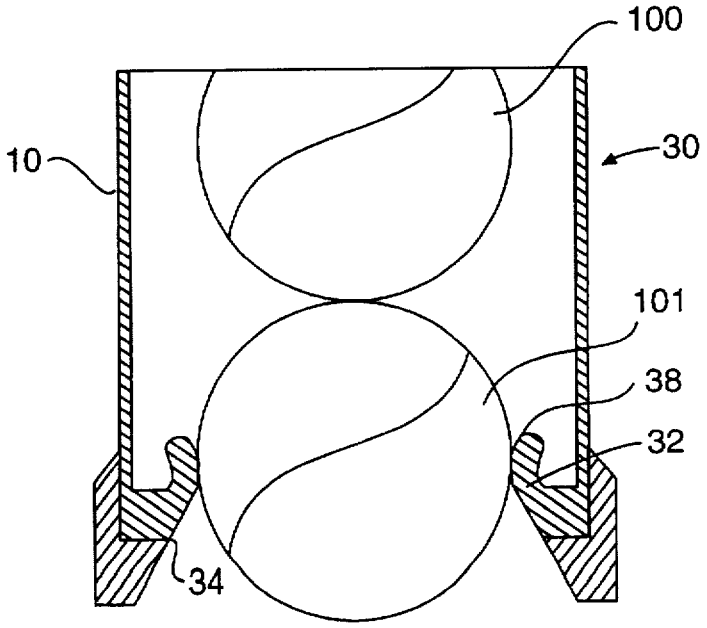
FIG. 5 shows a cut away side view of the lower cap.

FIG. 5 shows a cut away view of the lower annular ring member 30. In this illustration ball 100 is placed entirely within the hollow tube 10. Ball 101 situated is substantially within the lower annular ring member 30 and in partial contact with the upper diameter 38 of the resilient flexible flange member 32. In this embodiment the lower diameter 34 is slightly larger than the diameter of the ball 101, and the upper diameter 38 is slightly smaller than the diameter of the ball 101. This being the case, when the ball 101 is pushed through the lower annular ring member 30 by the downward motion of the ball system, the upper diameter 38 of the resilient flexible flange member 32 is flexed inward towards the wall of the hollow tube 10. Once the ball passes completely through the lower annular ring member 30, the diameter 38 of the resilient flexible flange member 32 returns to its original position. At this point, the ball 101 is securely placed within the hollow tube 10 and cannot fall out. The upper diameter 38 of the resilient flexible flange member 32 does not easily flex in other directions so that the balls, once placed within the hollow tube 10, cannot be removed easily from the hollow tube 10 through the lower annular ring member 30.

Figure 6:
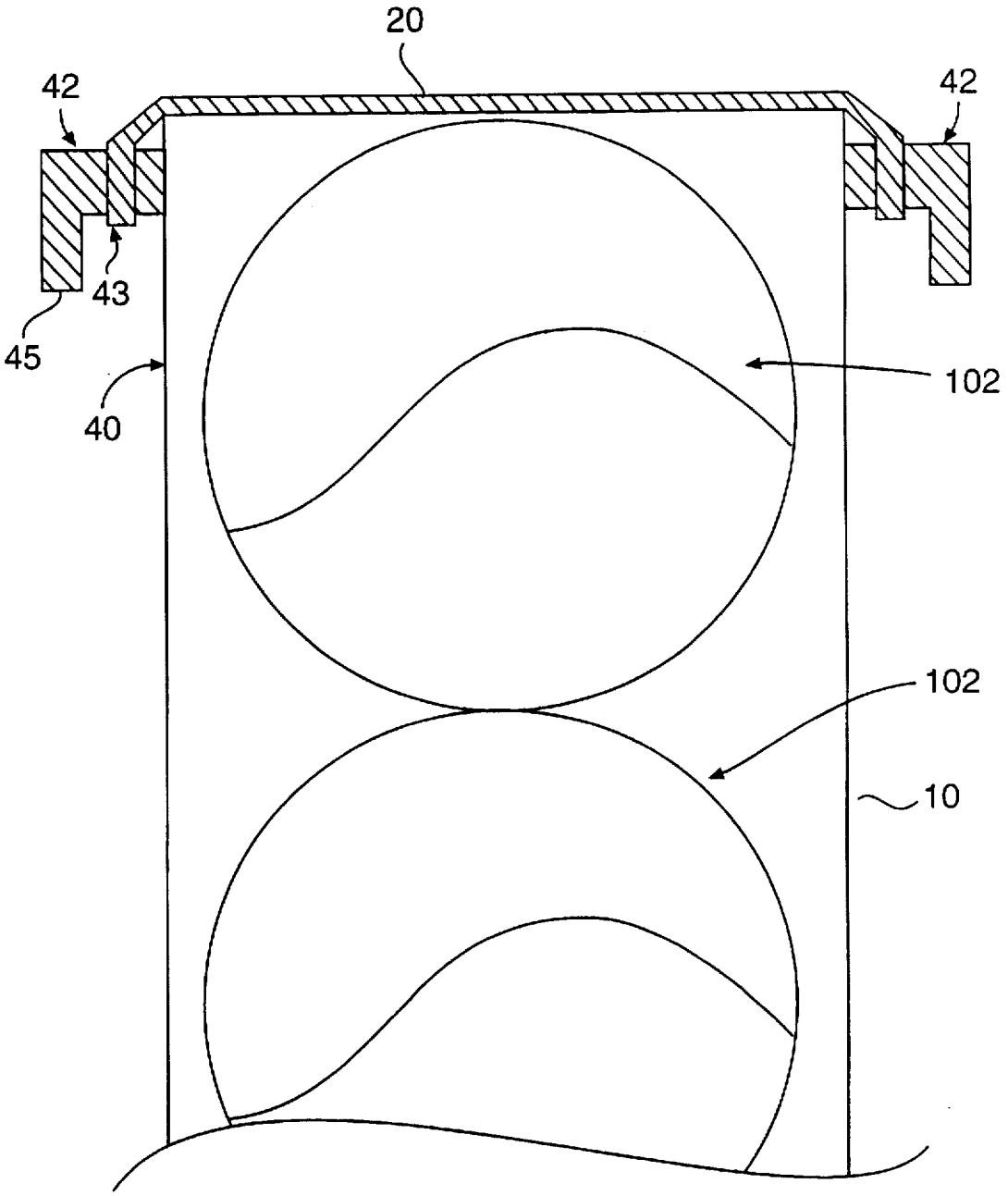
FIG. 6 shows a cut away view of the upper cap and hollow tube.

FIG. 6 shows a cut away view of the upper cap 40 and hollow tube 10. In this illustration, the elastic retaining band 20 is stretched over the hollow center portion 44 of the upper cap 40 and is secured to the hook members 42. The placement of the elastic retaining band 20 keeps the balls 102 securely placed within the hollow tube 10. The elastic retaining band 20 is secured to the horizontal leg 43 and the downward depending arm 45 prevents the elastic retaining band 20 from disengaging from the hook members 42. The balls can be removed from the hollow tube 10 when the elastic retaining band 20 is removed from at least one of the hook members 42.

Figure 7:
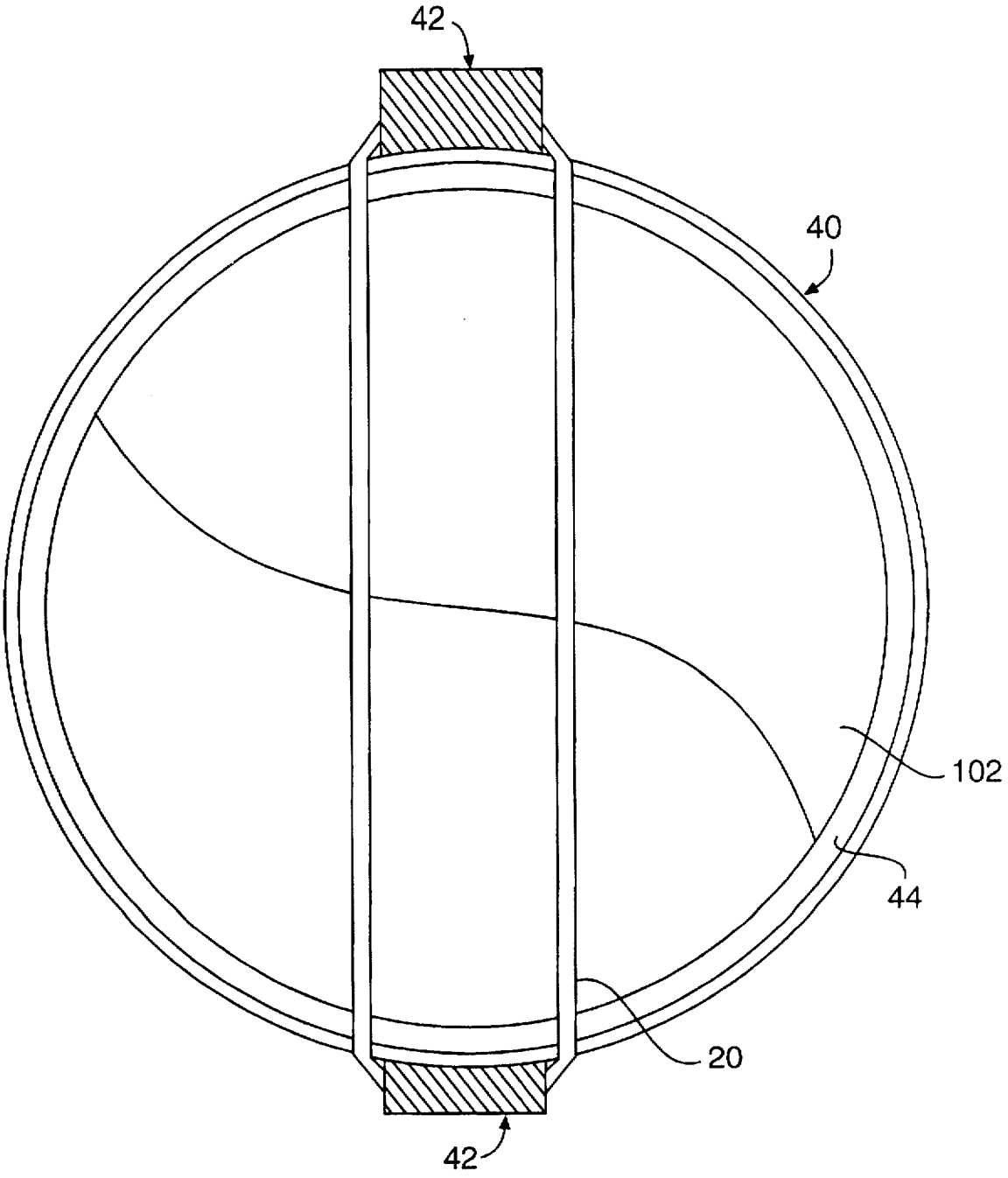
FIG. 7 shows a top view of the upper cap.

FIG. 7 shows a top view of the upper cap 40. As seen, the elastic retaining band 20 is secured to the hook members 42. This keeps the balls 102 securely situated within the hollow tube 10. Again, it is noted that the balls can be removed from the hollow tube 10 when the elastic retaining band 20 is removed at least one of from the hook members 42.

Figure 8:
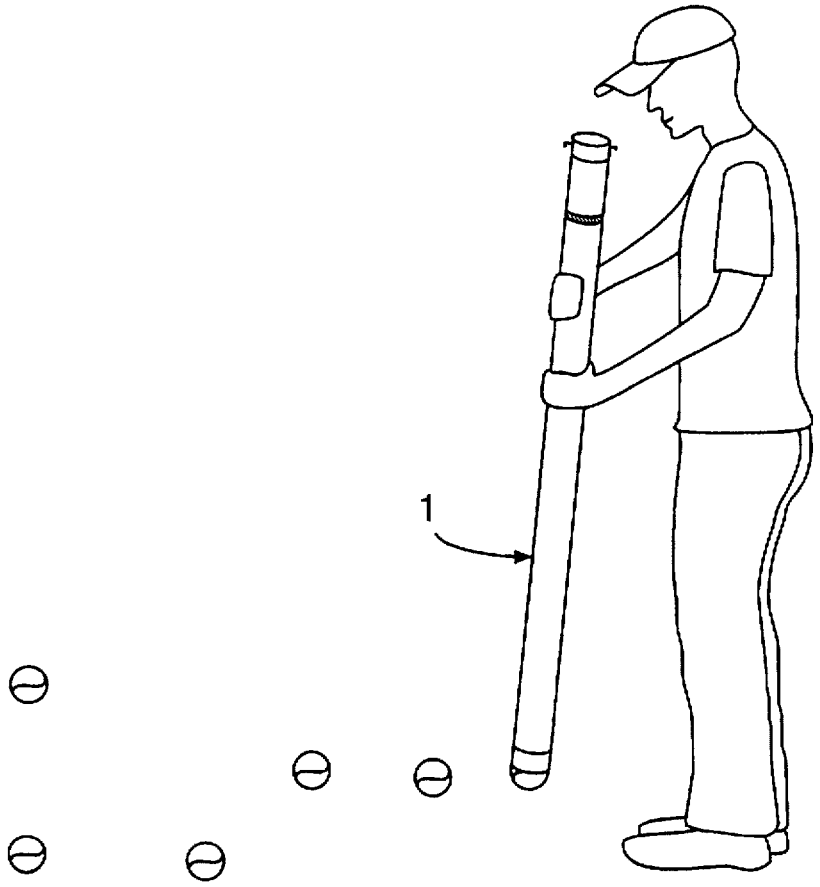
FIG. 8 shows a person picking up balls using the ball system.

FIG. 8 shows a person picking up balls using the ball system 1. In this embodiment, the person places the lower annular ring member 30 directly over the ball to be picked up. The person then presses the ball system 1 onto the ball until the ball passes entirely through the resilient flexible flange member 32 and into the hollow tube 10. In the preferred embodiment, up to 25 balls can be picked up in this manner, although this is not a limitation of the invention. In alternate embodiments, other amounts of balls can be placed with the ball system 1.

Once the balls are retained within the hollow tube 10, the elastic retaining band 20 may be placed over the hook members 42. Of course, the elastic retaining band 20 may be placed over the hook members prior to picking up the balls. As previously stated, placement of the elastic retaining band 20 over the hook members 42 prevents the balls from be removed from the upper end of the hollow tube 10.

The ball system may also be used as a tennis ball dispenser and practice and teaching aid. In this case, the elastic retaining band 20 is removed from the hook members 42 so that the balls may be removed from the upper cap 40 area.

Figure 9:
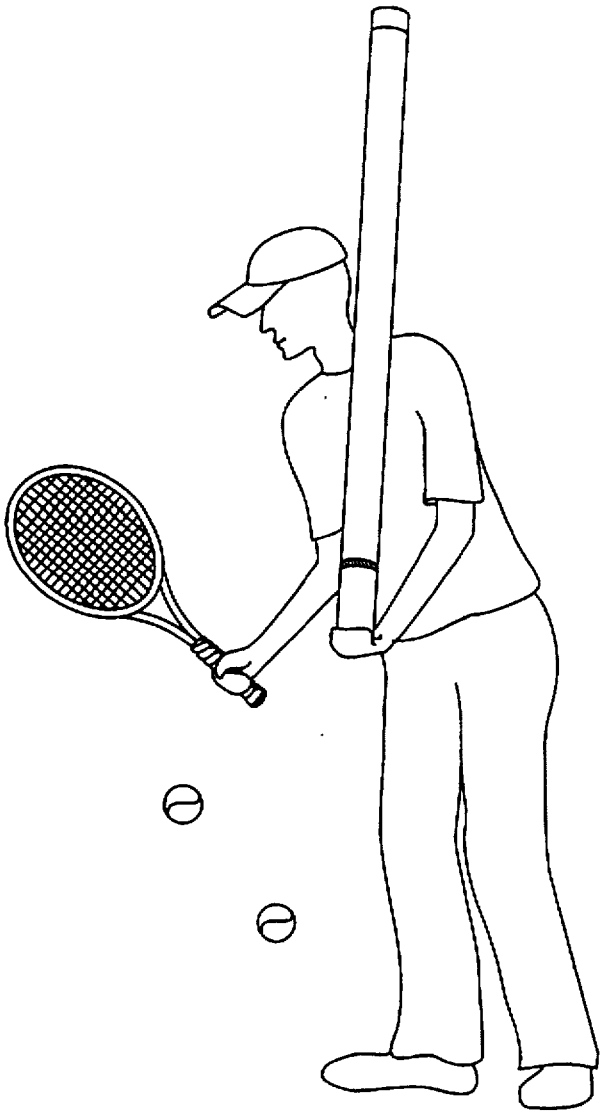
FIG. 9 show a person dispensing balls from the ball system.

FIG. 9 show a player removing balls from the ball system 1. In order to use the ball system 1 as a tennis practice and teaching aid, the player removes the elastic retaining band 20 from the hook mechanism 42. The player then places his free non-serving hand over the upper cap 40 (so that no balls will fall out of the ball system,) and then positions the ball system 1 so that the upper cap 40 is facing the ground. At this time the player rests the hollow tube 10 on his non-serving shoulder while keeping his hand over the upper cap 40. The player then releases one ball at a time from the ball system 1. In this manner, the player can hit the released ball with either a forehand or backhand stroke, which enables the player to practice his stroke.

The ball system 1 is also used as a court practice target device. In this case, the ball system 1 is horizontally placed at any desired location on the court. After the ball system 1 is placed on the court, the player then practices their accuracy shots by aiming at the ball system 1. This type of "target" practice develops accuracy skills for the player. Several ball systems may also be placed side-by-side or in other combinations. This enables the player to "target" specific zones on the court when practicing. Again, this aids the player in developing his hitting accuracy during practice sessions.

The detailed description of the present invention is based on a ball system. All numbers and dimensions that are used in this description are based on a tennis ball system. The dimensions of the ball system, including upper cap, lower annular ring member, tube size, and other dimensions and quantities specified herein, may vary with the size and type of ball system used with the present invention. Therefore, numbers and dimensions specified herein are not to be construed as limitations on the scope of the present invention, but are meant to be merely illustrative of one particular application.

Preferred and alternative embodiments of the present invention have now been described in detail. It is to be noted, however, that this description of these specific embodiments is merely illustrative of the principles underlying the inventive concept. It is therefore contemplated that various modifications of the disclosed embodiments will, without departing from the spirit and scope of the invention, be apparent to persons of ordinary skill in the art.

What is claimed is:

1. A ball retrieval, storage, dispensing, and court target practice device comprising:

(a) a hollow tube having a lower end, an upper end, and an inner diameter slightly larger than the diameter of a ball;

(b) a non-removable, unitary lower annular ring member with an inner circumference and an outer circumference, and positioned at the lower end of the hollow tube; and (c) a flexible flange member attached to the inner circumference of the non-removable, unitary lower annular ring member, the flexible flange member having an upwardly and outwardly pointed lower annular ring with an upper diameter and a lower diameter, wherein the upper diameter is smaller than the diameter of the ball, and the lower diameter is larger than the diameter of the ball.

2. The ball retrieval, storage, dispensing, and court target practice device of claim 1 further comprising an upper cap, with:

inner and outer sides positioned at the upper end of the hollow tube; and at least two hook members on opposite outer sides of the upper cap.

3. The ball retrieval, storage, dispensing, and court target practice device of claim 2 further comprising an elastic retaining band engaged about the hook members.

4. The ball retrieval, storage, dispensing, and court target practice device of claim 3, wherein the balls are removed from the hollow tube by removing the elastic band from the hook members and turning the hollow tube so that the upper cap substantially faces the ground.

5. The ball retrieval, storage, dispensing, and court target practice device of claim 2, wherein the hook members each comprise a horizontal leg and a downward depending leg integrally molded to the horizontal leg.

6. The ball retrieval, storage, dispensing, and court target practice device of claim 2, wherein the flexible flange member is integrally molded about the inner circumference of the non-removable, unitary lower annular ring member.

7. The ball retrieval, storage, dispensing, and court target practice device of claim 1 wherein the hollow tube is made from a lightweight flexible material.

8. The ball retrieval, storage, dispensing, and court target practice device of claim 1, wherein the upper diameter of the flexible flange bends inward when the ball is in contact therewith, and returns to an original position when the ball is not in contact therewith.

9. The ball retrieval, storage, dispensing, and court target practice device of claim 1, wherein the ball is selected from the group consisting of tennis ball, softball, baseball, handball, racquetball, squash ball, soccer ball, basketball, polo ball, billiard ball, golf ball, and croquet ball.

10. The ball retrieval, storage, dispensing, and court target practice device of claim 1 wherein the hollow tube securely holds balls that are placed within the hollow tube.

11. The ball retrieval, storage, dispensing, and court target practice device of claim 1, further comprising a ridge integrally molded about the outer circumference of the non-removable, unitary lower annular ring member, the ridge having an upper diameter and a lower diameter, wherein the upper diameter of the ridge is slightly larger than the diameter of the ball, and the lower diameter of the ridge is larger than the inner diameter of the hollow tube.

12. A tennis ball retrieval, storage, dispensing, and court target practice device comprising (a) a hollow tube having a lower end, an upper end, and an inner diameter slightly larger than the diameter of a tennis ball;

(b) a non-removable, unitary lower annular ring member with an inner circumference and an outer circumference, and positioned at the lower end of the hollow tube;

(c) a ridge attached about the outer circumference of the non-removable, unitary lower annular ring member, the ridge having an upper diameter and a lower diameter, wherein the upper diameter of the ridge is slightly larger than the diameter of the ball, and the lower diameter of the ridge is larger than the diameter of the tennis ball;

(d) a flexible flange member integrally molded about the inner circumference of the non-removable, unitary lower annular ring member, the flexible flange member having an upwardly and outwardly pointed annular ring with an upper diameter and a lower diameter, wherein the upper diameter is slightly smaller than the diameter of the tennis ball, and the lower diameter is substantially equal to the upper diameter of the ridge;

(e) an upper cap, with inner and outer sides, positioned at the upper end of the hollow tube, (f) at least two hook members attached to the outer sides of the upper cap; and (g) an elastic retaining band adapted to be removably engaged about the hook members.

13. The tennis ball retrieval, storage, dispensing, and court target practice device of claim 12, wherein the upper diameter of the flexible flange member bends inward when the tennis ball is in contact therewith and returns to an original position when the tennis ball is not in contact therewith.

14. The tennis ball retrieval, storage, dispensing, and court target practice device of claim 12 wherein the hollow tube securely holds the tennis balls that are placed within the hollow tube.

15. The tennis ball retrieval, storage, dispensing, and court target practice device of claim 12 wherein the hollow tube holds at least 10 tennis balls.

16. The tennis ball retrieval, storage, dispensing, and court target practice device of claim 12 wherein the balls are removed from the hollow tube by removing the elastic band from the hook members and turning the hollow tube so that the upper cap substantially faces the ground.

17. A method of retrieving and dispensing balls from a ball retrieval, storage, and dispensing system comprising the steps of:

(a) positioning a hollow tube having a non-removable, unitary annular ring member with a flexible flange member, the flexible flange member having an upper diameter slightly smaller than the diameter of a ball, and a lower diameter slightly larger than the diameter of the ball, directly over the ball to be picked up;

(b) pressing the hollow tube downward so that the ball passes through the flexible flange member and into the hollow tube; and (c) repeating steps (a) and (b) until all of the balls are picked up.

18. The method of retrieving and dispensing balls from a ball retrieval, storage, and dispensing system of claim 17, wherein the steps of storing the balls further comprises:

(a) placing an elastic band about a pair of hook members located on opposite outer sides of an upper cap placed on an upper portion of the hollow tube; and (b) storing the balls within the hollow tube.

19. The method of retrieving and dispensing balls from a ball ball retrieval, storage, dispensing, and court target practice device of claim 18 wherein the steps of dispensing the balls further comprises:

(a) removing the elastic band from the hook members;

(b) placing a hand over the upper cap of the hollow tube;

(c) positioning the hollow tube so that the upper cap is substantially facing the ground; and (d) removing the hand from the upper cap so that one ball at a time is dispensed from the hollow tube.

* * * * *